US011064787B2

(12) United States Patent
Liu

(10) Patent No.: US 11,064,787 B2
(45) Date of Patent: Jul. 20, 2021

(54) ENVIRONMENTALLY FRIENDLY LIPSTICK CASE

(71) Applicant: Ting Nan Liu, New Taipei (TW)

(72) Inventor: Ting Nan Liu, New Taipei (TW)

(73) Assignee: Zhuhai Ding Rong Plastic Products Co., LTD, Zhuhai (CN)

( * ) Notice: Subject to any disclaimer, the term of this patent is extended or adjusted under 35 U.S.C. 154(b) by 37 days.

(21) Appl. No.: 16/572,856

(22) Filed: Sep. 17, 2019

(65) Prior Publication Data

US 2021/0076802 A1 Mar. 18, 2021

(51) Int. Cl.
*A45D 40/06* (2006.01)
*A45D 40/00* (2006.01)

(52) U.S. Cl.
CPC ..... *A45D 40/06* (2013.01); *A45D 2040/0025* (2013.01); *A45D 2040/0062* (2013.01); *A45D 2200/05* (2013.01)

(58) Field of Classification Search
CPC ..... A45D 40/06; A45D 40/04; A45D 40/00; A45D 40/20; A45D 2040/00; A45D 2040/20; A45D 2040/205; A45D 2200/005; B65D 83/0022; B65D 83/0011; B65D 83/0027
USPC ..... 401/75, 77, 78, 82, 171, 172
See application file for complete search history.

(56) References Cited

U.S. PATENT DOCUMENTS

| | | | | |
|---|---|---|---|---|
| 6,200,048 | B1 * | 3/2001 | Bouix | A45D 40/06 401/78 |
| 6,412,999 | B1 * | 7/2002 | Pierpont | A45D 40/12 401/68 |
| 6,623,198 | B2 * | 9/2003 | Holloway | A45D 40/12 401/75 |
| 2002/0015611 | A1 * | 2/2002 | Blondeel | A45D 40/04 401/88 |

* cited by examiner

*Primary Examiner* — David J Walczak

(57) ABSTRACT

An environmentally friendly lipstick case formed of PET includes a cap including an internal annular groove on a bottom; a rotation tube including internal spiral guide grooves; an ascending and descending tube including two opposite guide pins on an outer surface, and longitudinal ribs on an inner surface; a support tube including two opposite longitudinal tunnels on a surface, each longitudinal tunnel having an upper horizontal end and a lower horizontal end oriented in a direction opposite to that of the upper horizontal end, and an annular toothed member on a bottom of an inner surface; and a lower exterior casing including an annular shoulder on an outer surface of an upper portion, projections between the annular shoulder and an open top, and a protrusion on a blind bottom disposed in the toothed member. The guide pins are moveably disposed through the longitudinal tunnels into the guide grooves.

4 Claims, 5 Drawing Sheets

ENVIRONMENTALLY FRIENDLY LIPSTICK CASE

BACKGROUND OF THE INVENTION

1. Field of the Invention

The invention relates to lipstick cases and more particularly to an environmentally friendly lipstick case formed of polyethylene terephthalate (PET) which is used in containers for foods.

2. Description of Related Art

A conventional lipstick case implements a mechanism of ascending or descending a lipstick by rotation. In detail, the conventional lipstick case comprises a casing, a rotation body, a carrier, a lipstick mounted on the carrier, a cap, and a lower exterior case. The components of the conventional lipstick case are made of polyoxymethylene (POM) and acrylonitrile butadiene styrene (ABS) resin.

However, assembly of the conventional lipstick case is difficult due to its multiple components. In addition, production is low, POM is white, ABS resin is yellow, and color of the lipstick case is limited to one. For changing color of the lipstick case, it is required to add other dyes of different colors to cover colors of both POM and ABS resin in the process of manufacturing the lipstick case. Unfortunately, it not only increases the manufacturing cost but also makes it impossible of making the color of the lipstick case to be a specific color.

Further, stability of the molecules of both POM and ABS resin is poor. Their chemical resistance is poor, i.e., being less resistant to both weak acid and strong acid. Furthermore, smell can be generated in the manufacturing process due to formaldehyde. In addition, its shaping speed is very low and its materials are not environmentally friendly and non-recyclable.

Different materials are used in manufacturing parts including the casing, the rotation body, the carrier, the lipstick mounted on the carrier, the cap, and the lower exterior case of the conventional lipstick case. Next, these parts assembled by means of ultrasonic waves. Unfortunately, it is uneasy to disassemble the conventional lipstick case after use because other plastics are added to the conventional lipstick case in the manufacturing process. This adds great difficulties to recycling.

Thus, the need for improvement still exists.

SUMMARY OF THE INVENTION

It is therefore one object of the invention to provide an environmentally friendly lipstick case comprising a cap formed of PET and including an annular groove on an open bottom of an inner surface; a rotation tube formed of PET, the rotation tube being hollow and including a plurality of spiral guide grooves formed on an inner surface; an ascending and descending tube formed of PET and including two opposite guide pins formed on an outer surface, and a plurality of parallel longitudinal ribs formed on an inner surface; a support tube formed of PET, the support tube being hollow and including two opposite longitudinal tunnels on a surface, each of the longitudinal tunnels having an upper horizontal end and a lower horizontal end oriented in a direction opposite to that of the upper horizontal end, and an annular toothed member on a bottom of an inner surface; and a lower exterior casing formed of PET, the lower exterior casing being a receptacle and including an annular shoulder on an outer surface of an upper portion, a plurality of projections between the annular shoulder and an open top, and a protrusion on a blind bottom configured to dispose in the toothed member; wherein the rotation tube is put on the support tube; wherein the ascending and descending tube is disposed in the support tube; wherein the guide pins are moveably disposed through the longitudinal tunnels into the guide grooves so that the guide pins are configured to anchor in the upper horizontal ends or the lower horizontal ends at an end of the movement; wherein the rotation tube is partially disposed in the lower exterior casing; wherein both the ascending and descending tube and the support tube are disposed in the lower exterior casing; wherein the protrusion is secured to the toothed member; and wherein the cap is releasably secured to the lower exterior casing by resting upon the annular shoulder and snapping the annular groove onto the projections.

The invention has the following advantages and benefits in comparison with the conventional art:

It is recyclable. The lipstick case is completely made of PET which is used in containers for foods. The lipstick case can be recycled after use and the recycled material can be used in manufacturing new products. This can achieve environmental sustainability by reducing pollution.

It decreases the manufacturing cost. The lipstick case is completely made of PET which is used in containers for foods. PET is transparent in nature. Thus, the lipstick case can be made colorless or any of other colors in the manufacturing process. It greatly decreases the consumption dye materials in the manufacturing process. It is not required to change the original color of the material. Therefore, it is possible of decreasing the manufacturing cost.

Shaping speed is very quick. There is no smell in the manufacturing process.

Stability of the molecules of PET is high and its chemical resistance is high because the lipstick case is completely made of PET which is used in containers for foods. Its manufacturing time is decreased about 50% in comparison with the conventional art, thereby greatly increasing the manufacturing efficiency, decreasing the energy consumption, and lowering greenhouse emissions. The recycled material can be used in manufacturing new products.

It assembly is simple. Only the rotation tube, the ascending and descending tube, and the support tube are assembled prior to assembling the lower exterior casing. Finally, the cap and the lower exterior casing are assembled. Moreover, the number of the components is much less than that of the conventional lipstick case.

The above and other objects, features and advantages of the invention will become apparent from the following detailed description taken with the accompanying drawings.

DETAILED DESCRIPTION OF THE INVENTION

Figure 1:
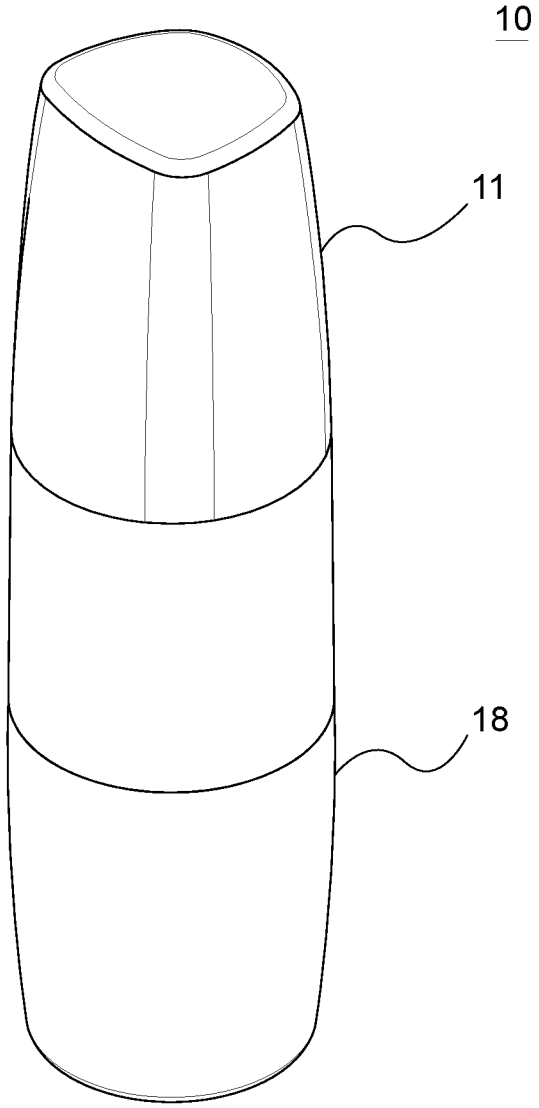
FIG. 1 is a perspective view of an environmentally friendly lipstick case according to the invention.
Figure 2:
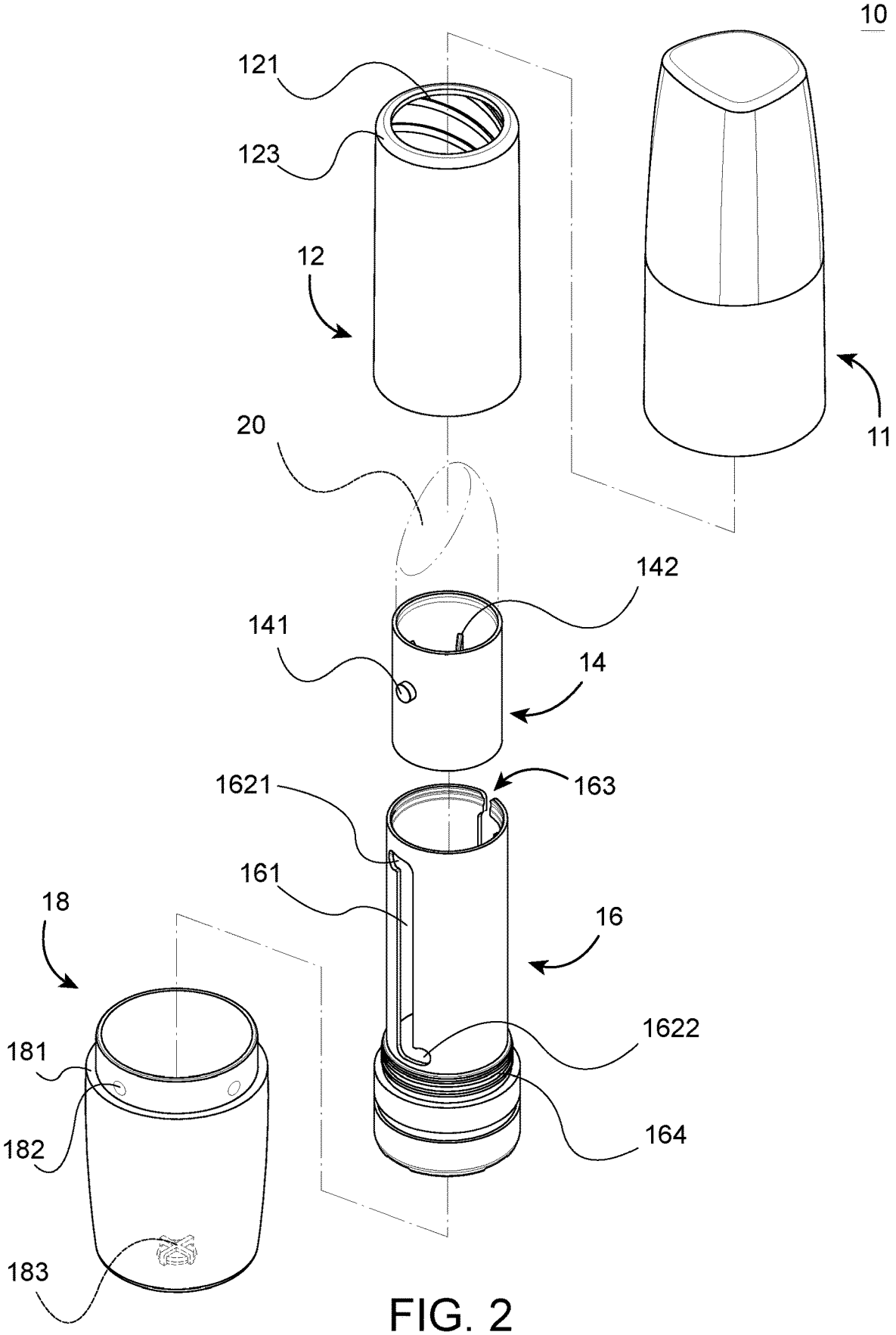
FIG. 2 is an exploded view of FIG. 1.

Referring to FIGS. 1 and 2, an environmentally friendly lipstick case 10 in accordance with the invention is shown.

The lipstick case 10 is formed of PET and comprises a cap 11, a rotation tube 12, an ascending and descending tube 14, a support tube 16, and a lower exterior casing 18 as detailed below.

Figure 3:
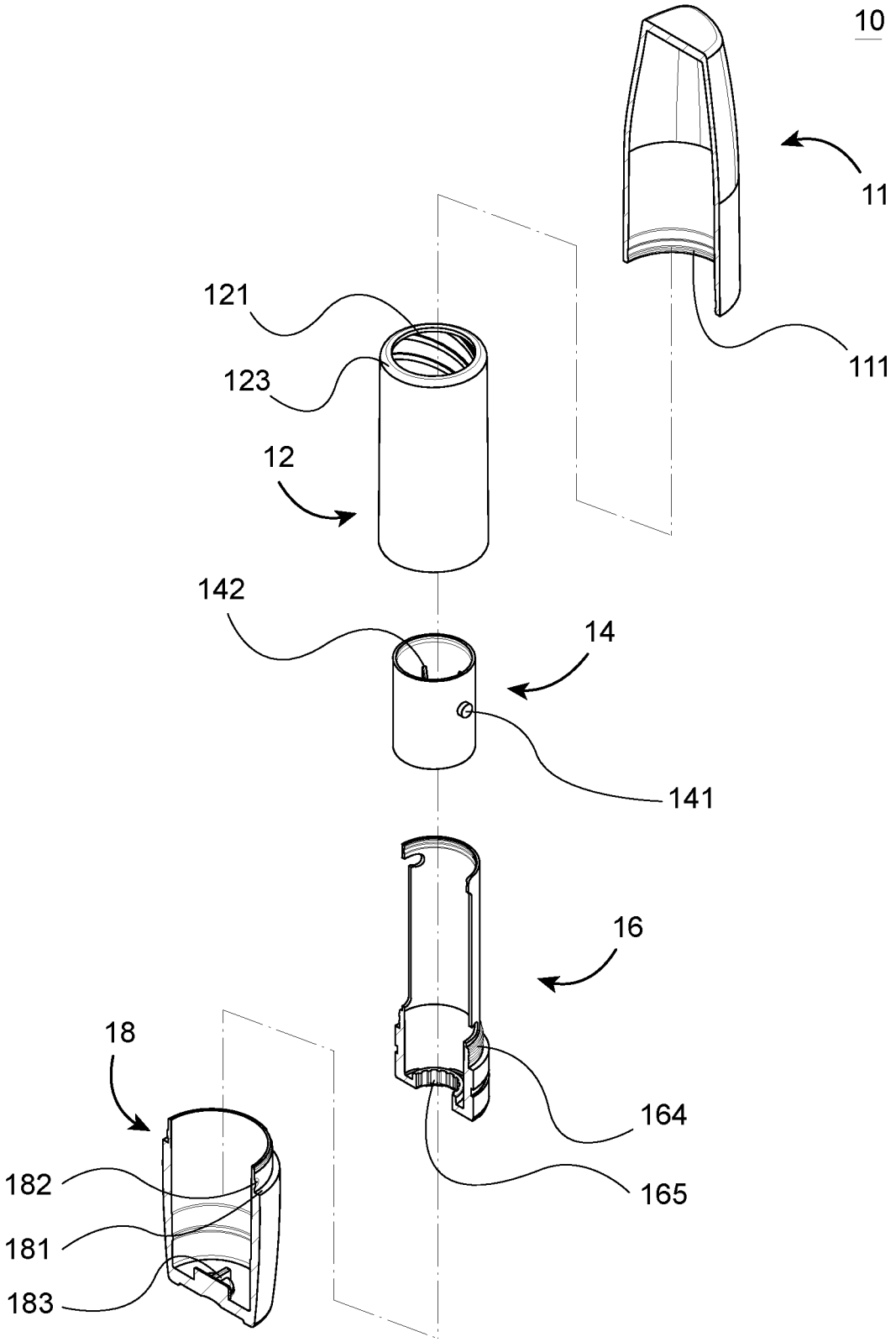
FIG. 3 is a longitudinal sectional view of some components of FIG. 2.
Figure 4:
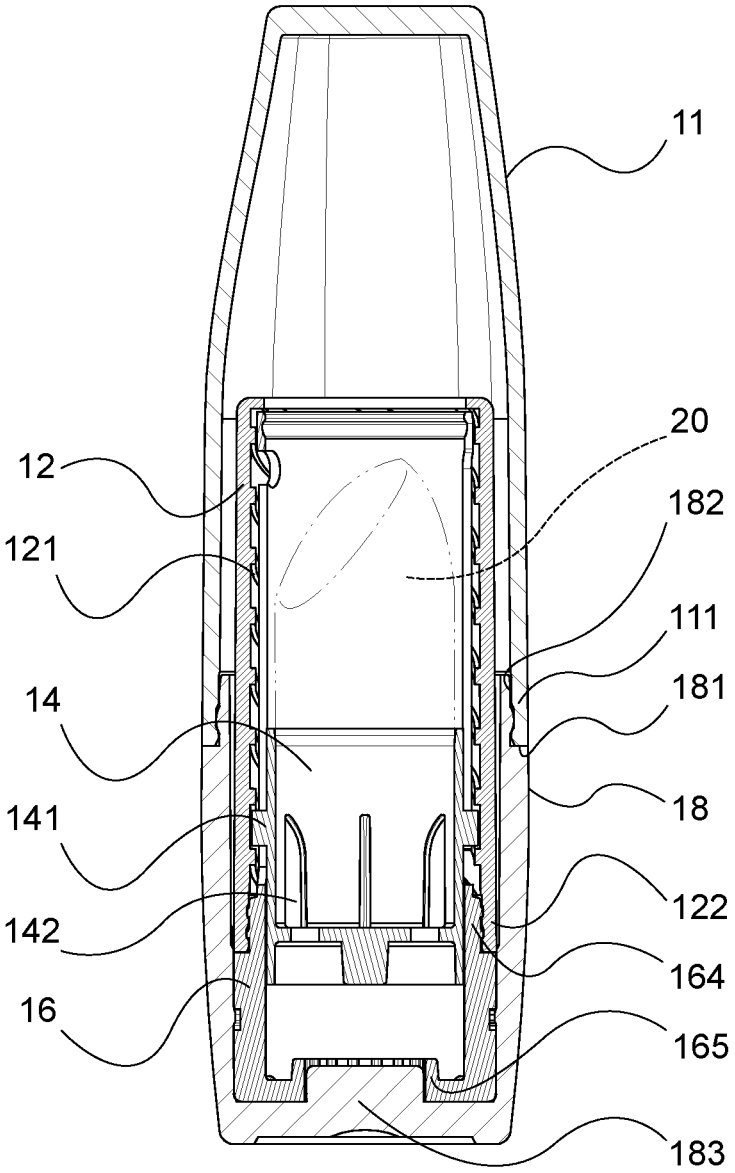
FIG. 4 is a longitudinal sectional view of FIG. 1.

Referring to FIGS. 3 and 4 in conjunction with FIG. 2, the cap 11 includes an annular groove 111 on an open bottom of an inner surface. The rotation tube 12 is hollow and includes a plurality of spiral guide grooves 121 on an inner surface. The ascending and descending tube 14 includes two opposite cylindrical guide pins 141 on an outer surface, and a plurality of parallel longitudinal ribs 142 on an inner surface for fastening a lipstick 20. The support tube 16 is hollow and includes two opposite longitudinal tunnels 161 on a cylindrical surface, each of the longitudinal tunnels 161 having an upper horizontal end 1621 and a lower horizontal end 1622 oriented in a direction opposite to that of the upper horizontal end 1621, and an annular toothed member 165 on a bottom of an inner surface. The lower exterior casing 18 is a receptacle and includes an annular shoulder 181 on an outer surface of an upper portion, a plurality of projections 182 between the shoulder 181 and an open top, and a protrusion 183 on a blind bottom configured to dispose in the toothed member 165. The rotation tube 12 is put on the support tube 16. The ascending and descending tube 14 is disposed in the support tube 16 and the cylindrical guide pins 141 are moveably disposed through the longitudinal tunnels 161 into the guide grooves 121. The cylindrical guide pins 141 are anchored in the upper horizontal ends 1621 or the lower horizontal ends 1622 at the end of the movement. The rotation tube 12 is partially disposed in the lower exterior casing 18. Both the ascending and descending tube 14 and the support tube 16 are disposed in the lower exterior casing 18. The protrusion 183 is secured to the toothed member 165. The cap 11 is releasably secured to the lower exterior casing 18 by resting upon the shoulder 181 and snapping the annular groove 111 onto the projections 182.

Referring to FIG. 2 again, the support tube 16 further comprises a longitudinal cut 163 through a top edge and communicating with one of the upper horizontal ends 1621. The longitudinal cut 163 has a width less than a diameter of the cylindrical guide pin 141. The provision of the longitudinal cut 163 prevents the support tube 16 from being damaged by thermal expansion in addition to facilitate the movements of the cylindrical guide pins 141 through the longitudinal tunnels 161. The rotation tube 12 further comprises a curved top edge 123 to prevent an individual from being hurt when applying the lipstick 20.

Referring to FIGS. 3 and 4 again, the guide grooves 121 are spirally formed on the inner surface of the rotation tube 12. The rotation tube 12 further comprises two parallel annular troughs 122 on the inner surface proximate a bottom edge. The support tube 16 further comprises two parallel annular ridges 164 configured to dispose in the annular troughs 122 when the rotation tube 12 is put on the support tube 16. The provision of the annular ridges 164 and the annular troughs 122 enhances a joining strength of the rotation tube 12 and the support tube 16. Further, the protrusion 183 disposed in the toothed member 165 secures the support tube 16 and the lower exterior casing 18 together. Thus, it greatly decreases a possibility of loosening the support tube 16 and the lower exterior casing 18.

Figure 5:
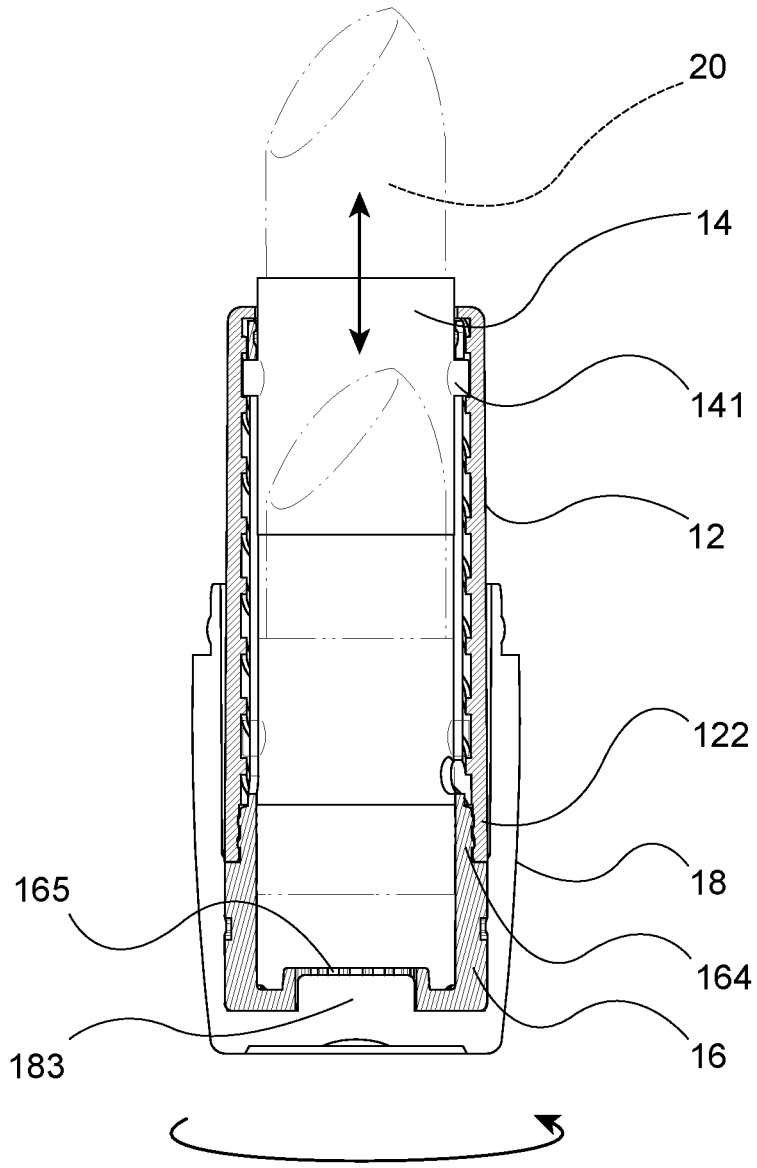
FIG. 5 is a view similar to FIG. 4 with the cap removed and showing an ascending or descending movement of the ascending and descending tube by rotating the rotation tube.

Referring to FIG. 5 in conjunction with FIG. 4, an individual may hold the lower exterior casing 18 with one hand and rotate the rotation tube 12 with the other hand. As a result, the ascending and descending tube 14 moves upward to lift the lipstick 20 or downward to lower the lipstick 20 by moving the cylindrical guide pins 141 along the spiral guide grooves 121.

While the invention has been described in terms of preferred embodiments, those skilled in the art will recognize that the invention can be practiced with modifications within the spirit and scope of the appended claims.

What is claimed is:

1. An environmentally friendly lipstick case, comprising:

a cap formed of polyethylene terephthalate (PET) and including an annular groove on an open bottom of an inner surface;

a rotation tube formed of PET, the rotation tube being hollow and including a plurality of spiral guide grooves on an inner surface;

an ascending and descending tube formed of PET and including two opposite guide pins on an outer surface, and a plurality of parallel longitudinal ribs on an inner surface;

a support tube formed of PET, the support tube being hollow and including two opposite longitudinal tunnels on a surface, each of the longitudinal tunnels having an upper horizontal end and a lower horizontal end oriented in a direction opposite to that of the upper horizontal end, and an annular toothed member on a bottom of an inner surface, and the support tube further comprising a longitudinal cut through a top edge and communicating with one of the upper horizontal ends, the longitudinal cut having a width less than a diameter of the guide pin; and a lower exterior casing formed of PET, the lower exterior casing being a receptacle and including an annular shoulder on an outer surface of an upper portion, a plurality of projections between the annular shoulder and an open top, and a protrusion on a blind bottom configured to dispose in the toothed member;

wherein the rotation tube is put on the support tube;

wherein the ascending and descending tube is disposed in the support tube;

wherein the guide pins are moveably disposed through the longitudinal tunnels into the spiral guide grooves so that the guide pins are configured to anchor in the upper horizontal ends or the lower horizontal ends at an end of the movement;

wherein the rotation tube is partially disposed in the lower exterior casing;

wherein both the ascending and descending tube and the support tube are disposed in the lower exterior casing;

wherein the protrusion is secured to the toothed member; and wherein the cap is releasably secured to the lower exterior casing by resting upon the annular shoulder and snapping the annular groove onto the projections.

2. The environmentally friendly lipstick case of claim 1, wherein the rotation tube further comprises at least one annular trough on the inner surface proximate a bottom edge, and the support tube further comprises at least one annular ridge configured to dispose in the annular trough when the rotation tube is put on the support tube.

3. The environmentally friendly lipstick case of claim 1, further comprising a lipstick fastened by the parallel longitudinal ribs of the ascending and descending tube.

4. The environmentally friendly lipstick case of claim 1, wherein the rotation tube further comprises a curved top edge.

* * * * *